US006158880A

United States Patent [19]

Giepen et al.

[11] Patent Number: 6,158,880

[45] Date of Patent: Dec. 12, 2000

[54] REFLECTOR LAMP

[75] Inventors: Bernd Giepen, Erwitte; Detlef Korff, Lippstadt; Frank Merkelbach, Erwitte, all of Germany

[73] Assignee: Hella KG Hueck & Co., Lippstadt, Germany

[21] Appl. No.: 09/143,532

[22] Filed: Aug. 28, 1998

[30] Foreign Application Priority Data

Sep. 6, 1997 [DE] Germany ..... 197 39 022

[51] Int. Cl.[7] ..... F21V 17/06

[52] U.S. Cl. ..... 362/438; 362/443; 362/226; 362/296

[58] Field of Search ..... 362/296, 226, 362/438, 439, 443

[56] References Cited

U.S. PATENT DOCUMENTS

| | | | |
|---|---|---|---|
| 4,219,870 | 8/1980 | Haraden et al. | 362/226 |
| 4,376,967 | 3/1983 | Hough | 362/306 |
| 4,820,956 | 4/1989 | Slobodzian et al. | 315/51 |
| 5,010,455 | 4/1991 | Luallin et al. | 362/226 |
| 5,294,863 | 3/1994 | Geboers et al. | 313/318 |
| 5,893,632 | 4/1999 | Kusagay et al. | 362/226 |

FOREIGN PATENT DOCUMENTS

| | | |
|---|---|---|
| 3101640 A1 | 8/1982 | Germany . |
| 3026484 C2 | 8/1983 | Germany . |

*Primary Examiner*—Sandra O'Shea
*Assistant Examiner*—Ali Alavi
*Attorney, Agent, or Firm*—Birch, Stewart, Kolasch & Birch, LLP

[57] ABSTRACT

A reflector lamp comprising a reflector and a light socket with light, in which the light socket can be rigidly connected to a receptacle located on the back of the reflector, has at least one connecting bracket on an outside of the socket that extends transversely to a longitudinal axis of the light socket and is guided longitudinally in a groove of the receptacle and can be positively connected by plastic deformation fit to the receptacle. A process for rigidly connecting the light socket and light to the receptacle involves adjusting the light socket and light in the reflector and positively connecting the light socket to the receptacle with laterally extending connecting brackets on the light socket that are guided in grooves in the receptacle for longitudinal displacement therealong.

13 Claims, 4 Drawing Sheets

REFLECTOR LAMP

BACKGROUND OF THE INVENTION

This invention relates to a reflector lamp comprising a reflector and a light socket with a light bulb, wherein the light socket is securely connectable to a receptacle at a back of the reflector.

The invention further relates to a process for rigidly connecting such a light socket and light bulb to such a receptacle.

German patent document (DE 30 26 484 C2) discloses a reflector lamp that has a reflector with a receptacle for a light housing on the back thereof. The light housing, equipped with a pre-focused light, is inserted from the back of the reflector into the receptacle, and is rigidly connected to the receptacle by ultrasonic welding. In this design, reflector tolerances, if any, cannot be compensated for in practice. Specifically, it is impossible to significantly displace the light socket longitudinally in the receptacle of the reflector.

German patent document (DE 31 01 640 A1) further discloses a design wherein a light socket with a light is inserted from a back of a reflector into a receptacle opening in the reflector and glued. It is disadvantageous in this arrangement, as well, that the light socket and light must be preadjusted, and variations in reflectors cannot be compensated for in practice.

An object of this invention is, therefore, to provide a rigid, or secure, connection between a light socket and a reflector, or its receptacle, in which a light bulb and its light socket can be focused at the focal point of the reflector.

Processes known in the prior art for rigidly connecting light socket to a reflector receptacle also exhibit the disadvantages described above.

Therefore it is a further object of this invention to provide a process for rigidly connecting a light socket and reflector that permits adjustment of the light socket in the reflector.

SUMMARY

According to principles of the invention a light socket has on its outside, facing an inside of a reflector receptacle in which the lamp socket is inserted, at least one connecting bracket; the bracket extending transversely of a longitudinal axis of the light socket and being guided in a groove in the receptacle so that the light socket may be displaced longitudinally therein and may be positively fit connected with the receptacle by plastic deformation.

Also according to principles of the invention the light socket, with a light bulb, or light, is adjusted in the reflector, and connecting brackets located laterally on the light socket, which are guided in grooves of the receptacle so that they can be displaced longitudinally, are rigidly connected to the receptacle of the reflector.

BRIEF DESCRIPTION OF THE DRAWING

The invention is described and explained in more detail below using an embodiment shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
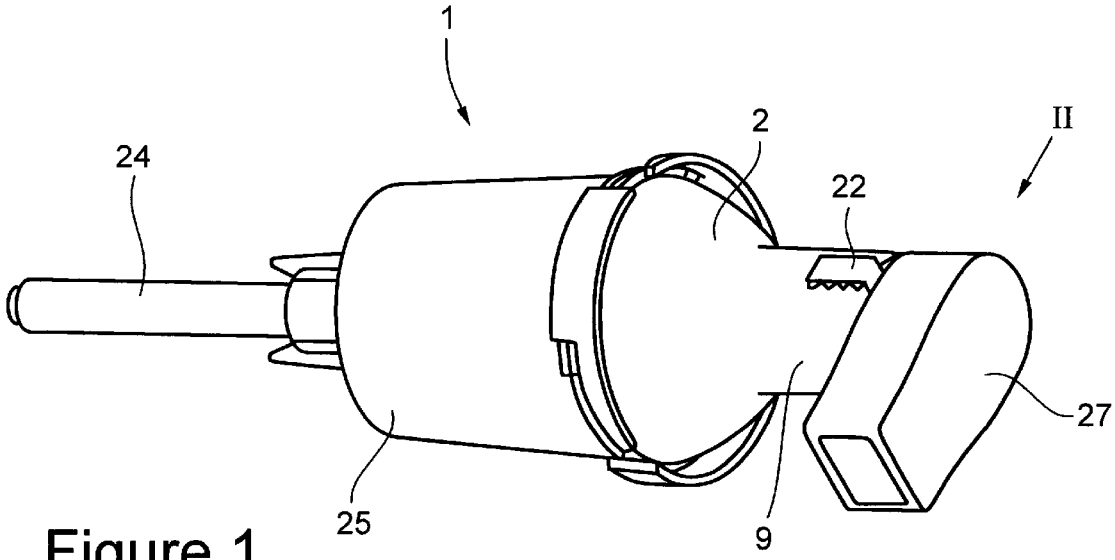
FIG. 1 is an isometric representation of a reflector lamp connected to a fiber optic cable, with a receptacle and a power supply plug.
Figure 2:
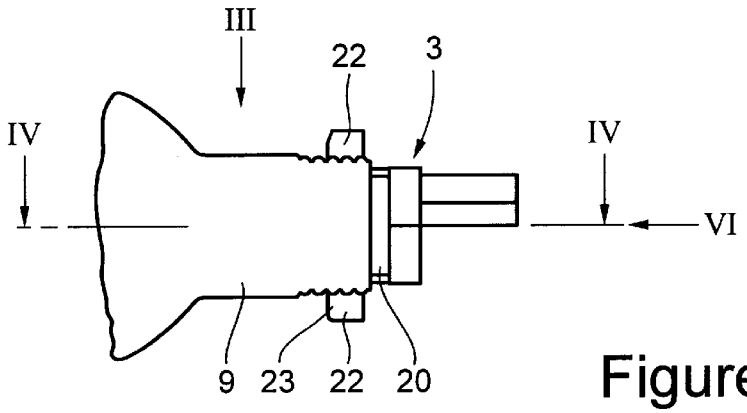
FIG. 2 is a view of the reflector lamp as seen from a direction II in FIG. 1, without a power supply plug.
Figure 3:
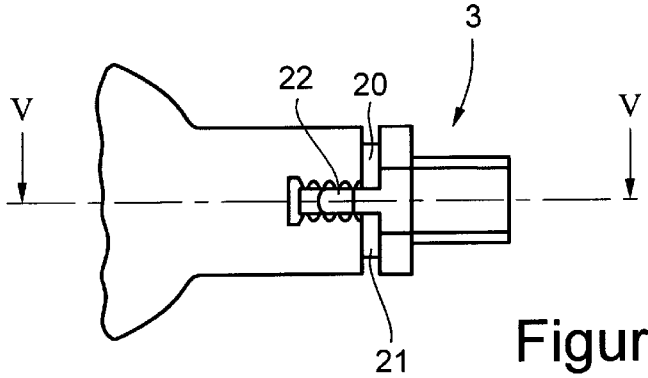
FIG. 3 is a view of the reflector lamp as seen from a direction III in FIG. 2.
Figure 4:
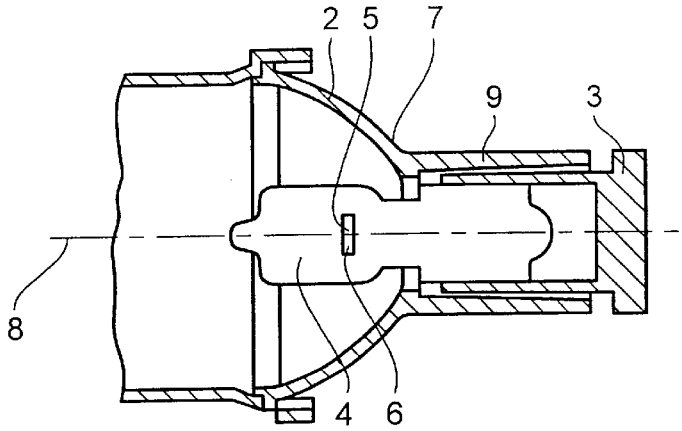
FIG. 4 is a sectional view of the reflector lamp taken along line IV—IV in FIG. 2.
Figure 5:
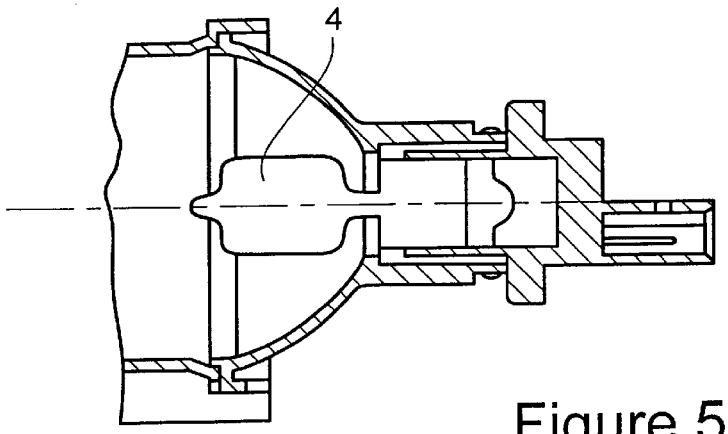
FIG. 5 is a sectional view of the reflector lamp taken along line V—V in FIG. 3.
Figure 6:
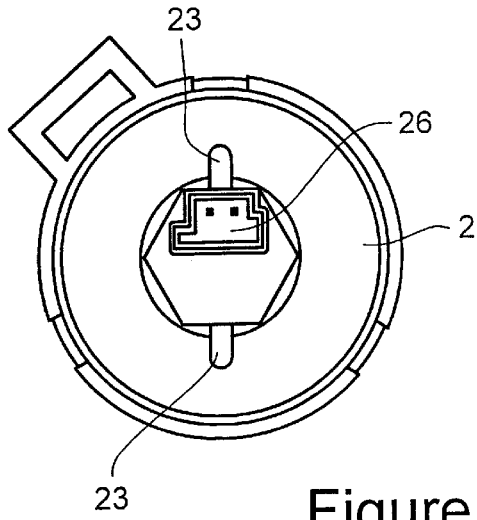
FIG. 6 is a view of the reflector lamp as seen from a direction VI in FIG. 2.
Figure 7:
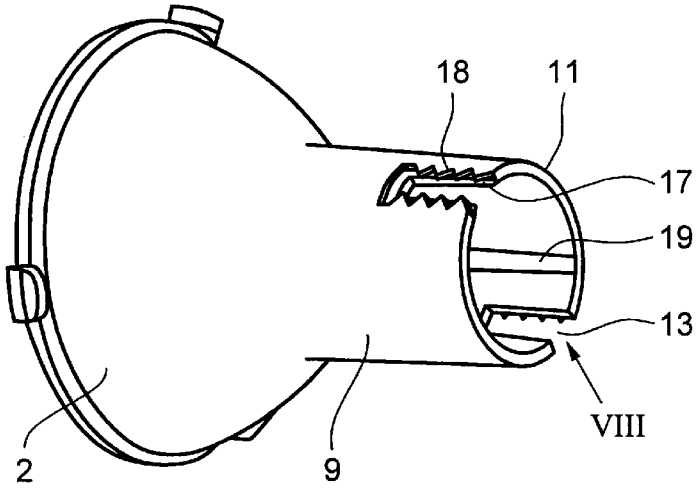
FIG. 7 is an isometric representation of a reflector of the reflector lamp of FIG. 1.
Figure 8:
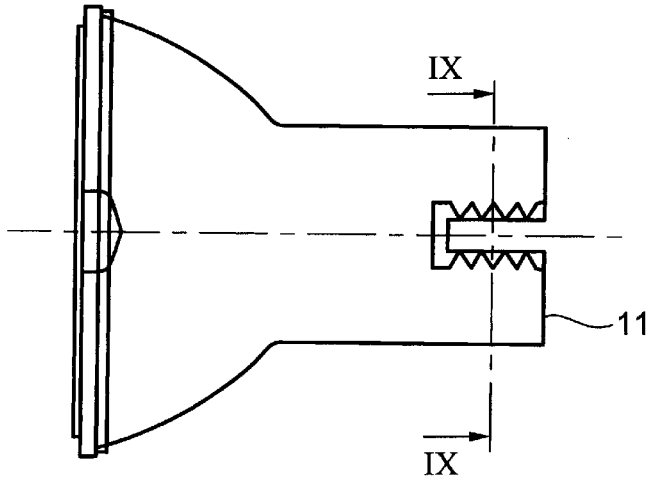
FIG. 8 is a lateral view of the reflector as seen from a direction VIII in FIG. 7.
Figure 9:
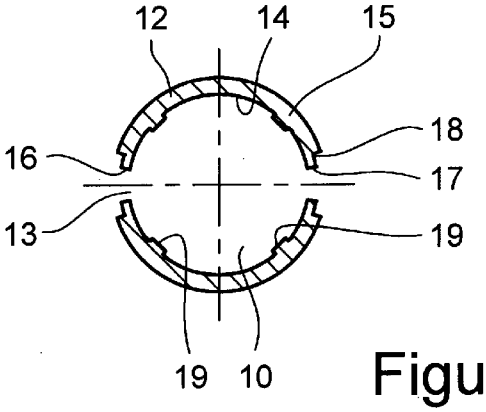
FIG. 9 is a sectional view of the reflector taken along line IX—IX in FIG. 8.
Figure 10:
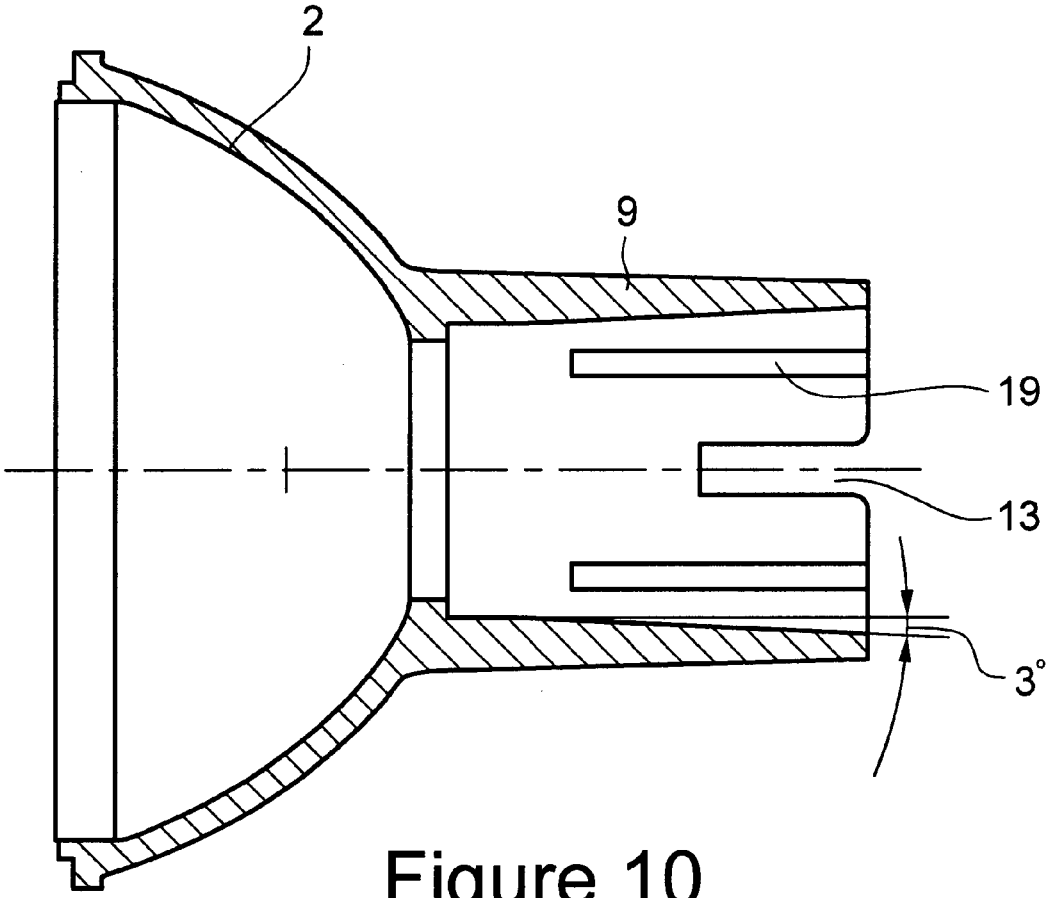
FIG. 10 is a sectional view of the reflector of FIG. 8.

A reflector lamp 1 comprises essentially a reflector 2, a light socket 3, and a light bulb, or light, 4.

The reflector 2 can be structured as an ellipsoid reflector, for example, which focuses light rays from a filament 6 of the light 4 located at the reflector's focal point 5 onto a second focal point (not shown). A receptacle 9 is concentrically positioned with respect to a longitudinal axis 8 of the reflector 2, on a back 7 of the reflector facing away from a direction of light beams. The receptacle 9 has a receiving opening 10 into which the light socket 3 with light 4 can be inserted from the back. The receptacle 9 has an edge facing 11 at its free end that faces away from the reflector 2. In a wall 12 surrounding the receiving opening 10, the receptacle 9 has two grooves 13 opposite each other. The grooves 13, formed as slots, are open toward the edge facing 11. The wall 12 is bounded by an inside 14 facing the longitudinal axis 8 and by an outside 15 facing away from the inside 14. Each groove 13 has two edge surfaces 16 located opposite each other which are structured as plane-parallel guide surfaces 17 in areas near the inside 14. In areas toward the outside 15, the edge surfaces 16 are provided with tooth-shaped areas 18.

The receiving opening 10 or the inside 14 of the receptacle 9 expands conically toward the edge facing 11 by approximately 3°. This makes it possible to tilt the light socket 3 with respect to the reflector 2 for adjustment purposes. The receptacle 9 has four longitudinal guide ridges 19 on the inside 14.

The light socket 3 has a lug 20 at an end facing toward the receptacle 9, which can be inserted into the receiving opening of the reflector 2. An outside 21 of the lug 20, facing toward the inside 14 of the receptacle 9, has two protruding connecting brackets 22 located opposite each other, which are guided in the grooves 13 of the wall 12 so that they can be displaced longitudinally therealong. Free end edges 23 of the connecting brackets 22 facing away from the lug 20 of the light socket 3 extend outwardly beyond the outside 15 of the wall 12. Thus, the connecting brackets 22 are arranged transversely with respect to the longitudinal axis 8. A position of a contact pin receptacle (not shown) is located a defined distance from the connecting brackets 22, so that the position of the filament 6 can be determined in a reproducible manner.

The reflector lamp 1 can be used to reflect light into a fiber-optic light guide 24, for example. To that end, the fiber-optic light guide 24 can be connected to the reflector 2 by a mounting 25.

At an end facing away from the reflector 2, the light socket 3 has an electrical connection 26 to which a power supply plug 27 can be connected.

For mounting, the light 4 is inserted into the light socket 3 and the power supply plug 27 is attached to the connection 26. The light socket 3 is inserted from the back 7 into the receiving opening 10, so that the connecting brackets 22 are guided by the guide surfaces 17. The filament 6 of the light 4 is focused by an adjusting device (not shown) which measures a focus and moves the filament with respect to the longitudinal axis 8 to the focal point 5 of the reflector 2, by sliding the light socket 3 and, if appropriate, by tilting it.

Once focusing has taken place, the free end portions, or end edges, 23 of the connecting brackets 22 are plastically deformed by means of hot stamping so that material of the free end edges 23 fills the tooth-shaped areas 18 of the grooves 13, at least partially, and a positive-fit connection is thereby established between the receptacle 9 and the light socket 3 by the connecting brackets 22.

The connecting brackets 22 can be made of a material such as polyetherimide (PEI), for example.

Because in this invention at least one connecting bracket is guided in a groove so that it can be displaced longitudinally, the light and its filament can be focused by simple longitudinal displacement of the light socket to the focal point of the reflector. Through plastic deformation of the guide bracket, the light socket can be connected rigidly to the reflector, that is to its receptacle.

In a preferred embodiment of the invention, the light socket has two connecting brackets opposite each other; ends of these brackets that face away from the light socket extend out beyond the grooved wall of the receptacle. The edge surfaces of the grooves facing each other are equipped with tooth-shaped areas that can be filled, at least partially, with material of plastically deformed end portions of the connecting brackets. Uniform loading during the plastic deformation is achieved by having the two connecting brackets lying opposite each other. A positive fit is achieved through the tooth-shaped areas of the groove, securely preventing longitudinal displacement of the light socket after the plastic deformation of the connecting brackets has taken place. In other words, the connecting brackets are formed to a new permanent shape.

By adjusting the light socket in the reflector, pre-adjustment of the light socket can be omitted and tolerances in the reflector can be compensated for. A secure, simple, and rapid connection of the light socket to the reflector is achieved through a positive fit between the connecting brackets and the receptacle.

In a preferred embodiment of a process according to the invention, the free ends of the connecting brackets facing away from the receptacle are deformed by hot stamping.

Hot stamping makes it possible to achieve a particularly rapid and secure connection between a light housing and a reflector.

In a further preferred embodiment, the filament of the light is focused with respect to the longitudinal axis of the reflector through longitudinal displacement of the light socket at the focal point of the reflector, by use of an adjusting device.

A particularly secure and rapid adjustment of the light is made possible by using an adjusting device.

The invention claimed is:

1. A reflector lamp comprising a reflector, with a receptacle located on a back of the reflector having a wall defining at least one groove therein, a light socket and light, with the light socket being rigidly connectable to the receptacle, wherein the light socket has, on its outside that faces toward an inside of the receptacle, at least one connecting bracket, said at least one connecting bracket extending transversely with respect to a longitudinal axis of the light socket and being guided in the at least one groove of the receptacle to be longitudinally displaced and being structured to be connected to the receptacle by plastic deformation with a shape of the connecting bracket being permanently changed to positively inter-engage with the receptacle.

2. A reflector lamp as in claim 1, wherein two connecting brackets are located opposite each other and are arranged transversely with respect to the light socket, the two connecting brackets having free end edges facing away from the light socket, with each bracket extending in a groove through a wall of the receptacle.

3. A reflector lamp as in claim 1, wherein a free end edge of the connecting bracket facing away from the light socket can be plastically deformed thereby permanently changing the shape of the connecting bracket so that the connecting bracket positively inter-engages with the receptacle.

4. A reflector lamp as in claim 1, wherein the groove has two edge surfaces with tooth-shaped areas located opposite each other, which can be filled at least partially with material of which the connecting bracket is made upon plastic deformation of the connecting bracket.

5. A reflector lamp as in claim 1, wherein the inside of the receptacle has longitudinally arranged guide ridges that guide the light socket.

6. A reflector lamp as in claim 1, wherein the inside of the receptacle expands conically toward an end facing away from the reflector.

7. A process for rigidly connecting a light socket, and light attached to the socket, to a receptacle located on a back of a reflector, wherein positions of the light socket and light are adjusted in the receptacle and the light socket is then connected positively to the receptacle, said process comprising the steps of providing longitudinal grooves along the receptacle; providing connecting brackets extending laterally on the light socket; causing the connecting brackets to slide in and along the grooves until the light is adjusted to a desired position relative to the reflector; plastically deforming the connecting brackets on the light socket which are longitudinally guided along the grooves in the receptacle so that shapes of the connecting brackets are permanently changed to inter-engage with the receptacle.

8. A process as in claim 7, wherein free end edges of the connecting brackets facing away from the receptacle are plastically deformed.

9. A process as in claim 8, wherein the free end edges of the connecting brackets facing away from the receptacle are deformed by hot stamping.

10. A process as in claim 7, wherein a filament of the light is focused with respect to a longitudinal axis of the reflector by causing longitudinal displacement of the light socket at the focal point of the reflector with an adjusting device.

11. A reflector lamp as in claim 1, wherein the at least one groove extends through the wall of the receptacle, with the at least one connecting bracket extending through the groove, and wherein an edge of the receptacle defining the at least one groove has an irregular shape for inter-engaging with the connecting bracket upon said plastic deformation of the connecting bracket.

12. A process as in claim 7, wherein the longitudinal grooves provided pass through a wall of the receptacle and are formed by irregularly shaped edges for inter-engaging with the connecting brackets during the step of plastically deforming the connecting brackets.

13. A reflector lamp as in claim 1, wherein the light socket is insertable into the receptacle from the back of the reflector.

* * * * *